United States Patent [19]

Gugeler

[11] 3,964,194

[45] June 22, 1976

[54] CHANGEABLE COLOR DISPLAY DEVICE

[76] Inventor: William G. Gugeler, 200 S. Vance, Lombard, Ill. 60148

[22] Filed: Jan. 22, 1975

[21] Appl. No.: 543,116

[52] U.S. Cl. ..... 40/106.21; 40/219; 220/246; 240/10 A

[51] Int. Cl.[2] ..... G09F 13/24

[58] Field of Search..... 40/106.21, 106.22, 106.23, 40/77, 37, 219; 240/2 LC, 2 LF, 10 A; 272/8 R; 43/56, 57; 119/5; 220/246, 304, 378

[56] References Cited

UNITED STATES PATENTS

| | | | |
|---|---|---|---|
| 2,616,585 | 11/1952 | Condit et al. | 220/246 |
| 3,388,490 | 6/1968 | Stechemesser | 40/106.21 |
| 3,610,918 | 10/1971 | Barlow | 40/219 X |
| 3,692,382 | 9/1972 | Cloutier | 40/106.21 X |
| 3,706,149 | 12/1972 | Olivieri | 40/106.22 |
| 3,745,678 | 7/1973 | Thomassen | 40/219 X |
| 3,780,260 | 12/1973 | Elsner | 240/2 LC X |

*Primary Examiner*—John F. Pitrelli
*Attorney, Agent, or Firm*—Hill, Gross, Simpson, Van Santen, Steadman, Chiara & Simpson

[57] ABSTRACT

A sealing cap prevents viscous fluid leakage from a display device of the type adapted for producing a constantly changing completely random multi-colored effect by the action of air bubbles traveling upwardly through the fluid contained in narrow working chamber gaps between parallel light transmissive walls of the device. An illumination source is provided for transmitting light through the walls and the fluid. Bubbling air is supplied from a manifold at the lower ends of the fluid containing gaps and vents from the upper ends of the gaps. A selectively displaceable sealing cap guards against leakage from the vents when the device is shut down. A reflective surface over the outer face of the device provides an opaque appearance when it is shut down.

18 Claims, 10 Drawing Figures

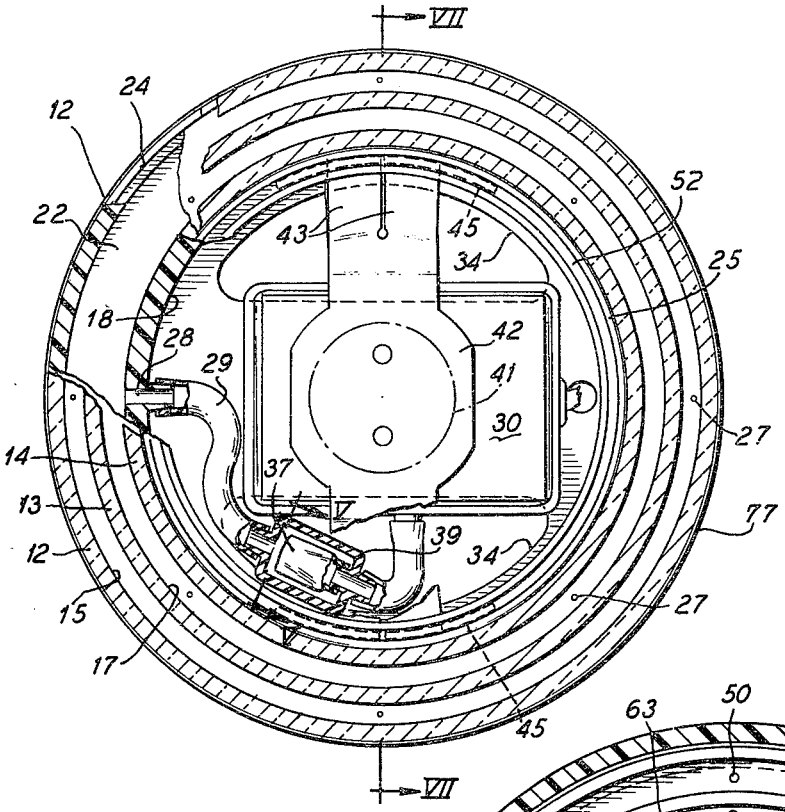
Fig. 4
Fig. 5
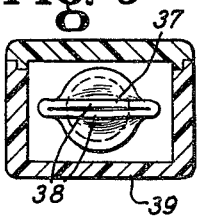
Fig. 6
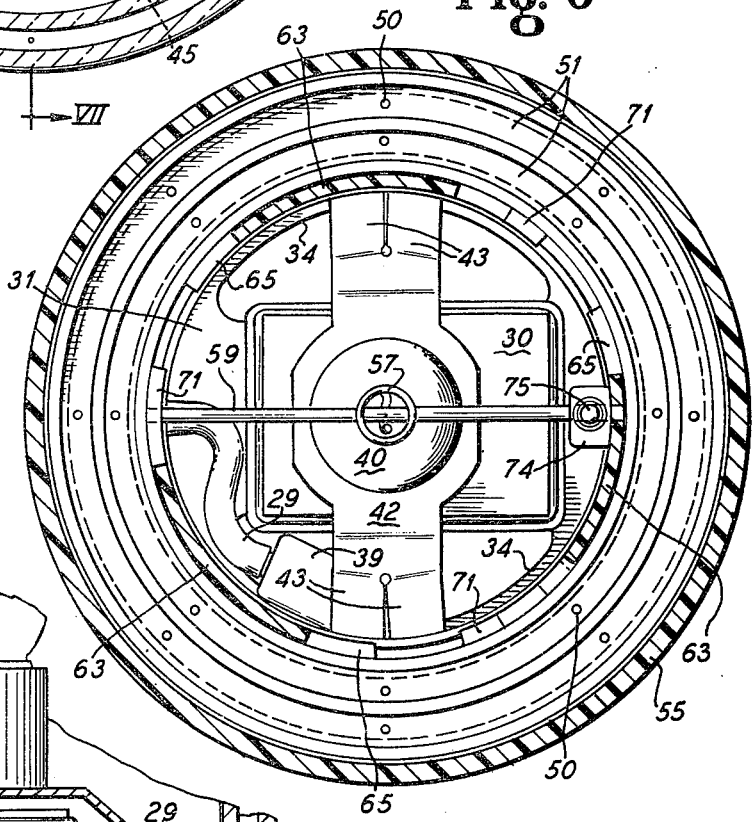
Fig. 7
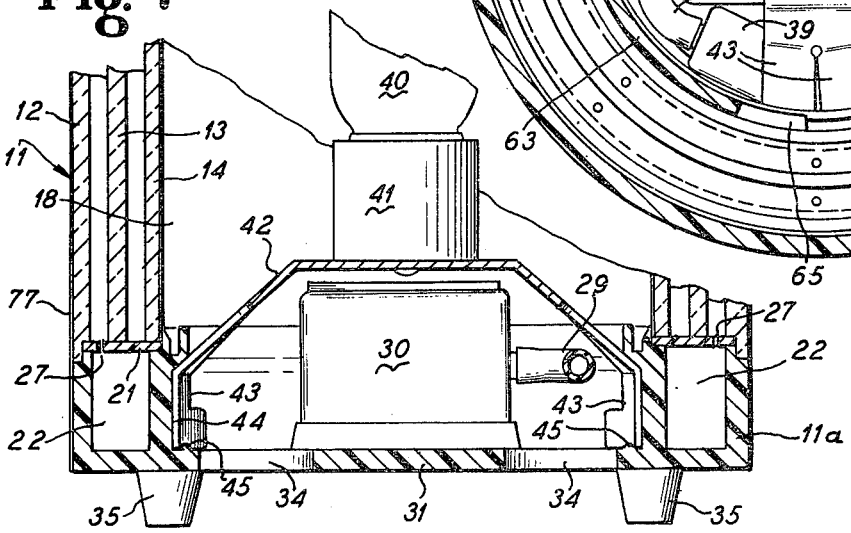

CHANGEABLE COLOR DISPLAY DEVICE

This invention relates to animated display devices in general, and is more particularly concerned with a device in which attractive visual effects are produced by upwardly intruding air within juxtaposed narrow gap chambers defined between light transmissive walls and partially filled with colored viscous fluid.

A display device of the kind to which the present invention is related is disclosed in U.S. Pat. No. 3,706,149, dated Dec. 19, 1972. Interesting constantly changing visual effects are obtained by intruding air upwardly through a plurality of juxtaposed chambers separated by transparent walls, the fluid in each chamber being of a different color.

The present invention provides a number of desirable and advantageous improvements over the device disclosed in the patent.

One improvement according to the present invention comprises means for sealing the device against leakage of fluid when it is shut down. This enables safe storage and transportation of the device without danger of leakage should it be tipped on its side, or even inverted.

Another feature of the invention resides in increasing the multi-colored visual effects attainable with the device.

A further feature of the invention resides in the provision of new and improved means for controlling operation of the device.

A still further feature of the invention resides in the provision of a light filtering surface on the unit so that when the unit is shut down, that is the illuminating lamp is off, the interior of the device is in effect invisible or concealed. Thereby, although the device may appear opaque when shut down, upon illumination by the light source, translucence of the walls and the viscous fluid is instantly apparent.

Other objects, features and advantages of the invention will be readily apparent from the following description of the preferred embodiments thereof, taken in conjunction with the accompanying drawings although variations and modifications may be effected without departing from the spirit and scope of the novel concepts embodied in the disclosure, and in which:

FIG. 4 is a horizontal sectional and plan detail view taken substantially along the line IV—IV of FIG. 2;

FIG. 5 is an enlarged fragmentary sectional elevational view taken substantially along the line V—V of FIG. 4;

FIG. 6 is a transverse sectional plan view taken substantially along the line VI—VI of FIG. 2;

FIG. 7 is a fragmentary vertical sectional elevational view taken substantially along the line VII—VII of FIG. 4;

Figure 2:
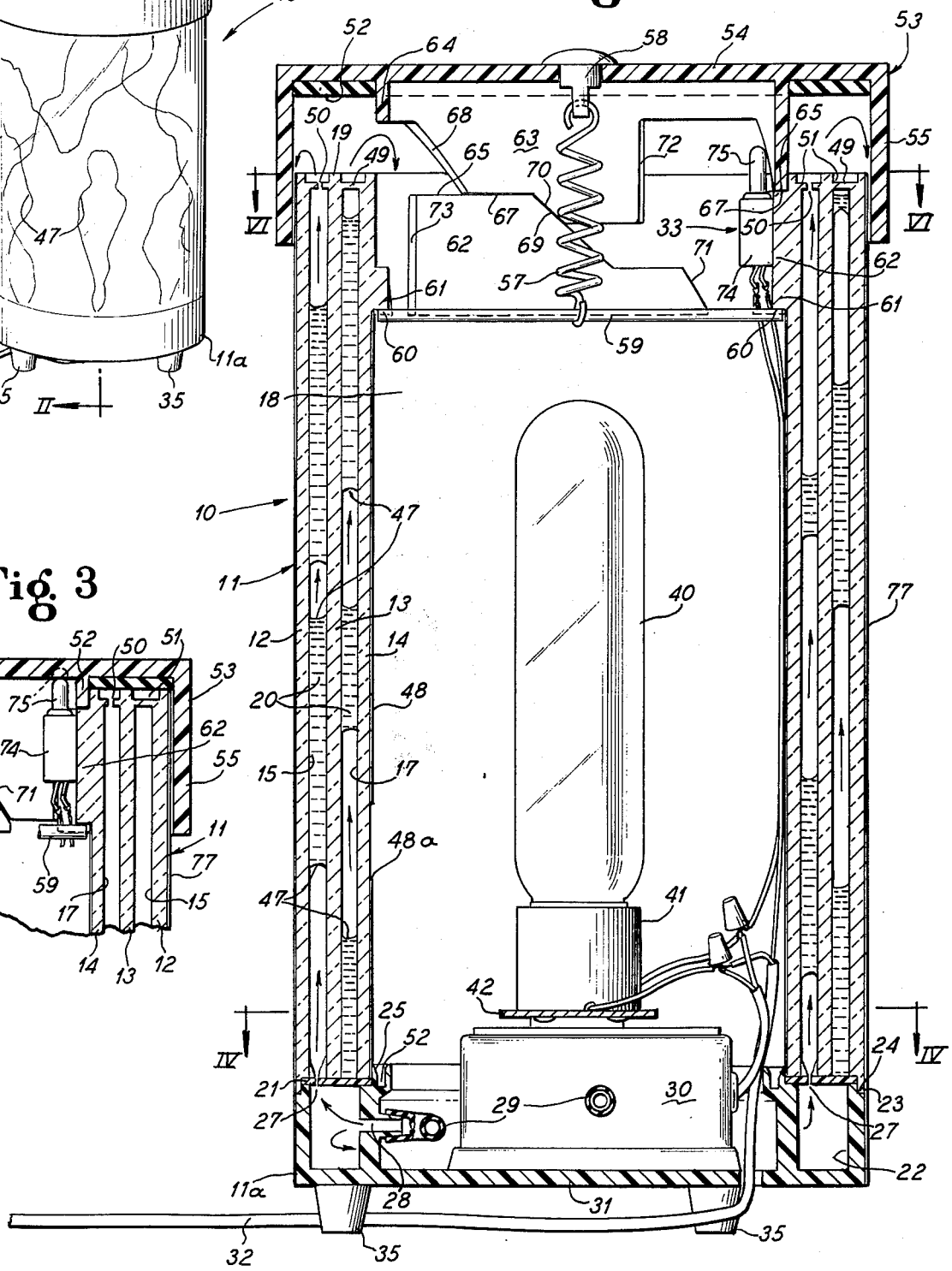
FIG. 2 is an enlarged vertical sectional elevational detail view taken substantially along the line II—II of FIG. 1.

A changeable color display device 10 embodying features of the present invention is desirably of generally cylindrical form, although other geometrical shapes are feasible and may be employed if preferred. To this end, the device 10 comprises a vertically standing tubular body II supported by a base 11*a*. As best seen in FIGS. 2, 4 and 6, the body II preferably comprises a plurality of concentric substantially coextensive tubular sections of differential diameter including an outer wall section 12 of largest diameter, an intermediate wall section 13 of smaller diameter and an inner wall section 14 of smallest diameter. Thereby an annular upright gap chamber 15 is defined between the wall sections 12 and 13 and an annular upright gap chamber 17 is defined between the wall sections 13 and 14. Within the innermost of the wall sections 14 there is provided a large diameter illumination compartment 18. Although each of the wall sections 12, 13 and 14 may be formed as a separate tubular member, in a desirable construction, they may be integrally joined in one piece, in this instance being connected together at their upper ends by a common head web 19. Any suitably translucent material may be employed in making the body 10, such as glass, or a suitable synthetic plastic material such as acrylic, and the like. Each of the wall sections 12, 13 and 14 may be as thin or as thick as preferred, although the thinner the material, the more economical the construction and the lighter the weight will be. In a typical arrangement, the chambers 15 and 17 may be gaps on the order ⅛ to 3/16 inch (3 to 5 mm) for efficient operation with viscous liquid 20 therebetween having a viscosity, on the order of a thick grade of lubricating oil, silicone of similar viscosity, or the like, about 20,000 centistokes viscosity being desirable. Heavier or lighter viscosity fluid may be used, with variation in gap width. At their lower ends, the chambers 15 and 17 may be sealed by means of an annular closure disk 21.

Conveniently, the base 11*a* may be a cast or molded member of any suitable material, a rigid plastic material being indicated and on which the lower end of the body 10 is mounted. In a desirable construction, the base 11*a* is provided with an annular manifold cavity 22 which opens upwardly and is dimensioned to underlie the body chambers 15 and 17 with the closure disk 21 serving to close the upper end of the manifold cavity. For connecting the body 10, preferably permanently, to the base 11*a* the outer wall section 12 is provided at its lower end with an annular depending flange extension 23 seating in and desirably permanently affixed to a rabbet groove seat 24 in the upper end of the base 11*a*. Additional sealing of the joint between the lower end of the body 11 and the base 11*a* is desirably effected by means of an annular upwardly extending flange 25 engaging about the inner lower margin of the inner wall section 14.

Means are provided for intruding air into the lower ends of the chambers 15 and 17 to bubble up through the viscous liquid 20. To this end, annular series of small spaced holes 27 are provided in the closure disk 21 providing communication between the air manifold chamber 22 and the respective vertical bubble action chambers 15 and 17. Each of the orifices 27 is of large enough diameter to pass a significant bubble volume of air from the chamber 22 into the respective associated chamber 15 or 17, but small enough to provide satisfactory frictional resistance to leakage of the viscous fluid 20 during nonoperating intervals of the device. In one satisfactory arrangement, the air intrusion orifices 27 are of a small size which may be formed by a No. 95 drill and they are located about 90° apart in each chamber series, and relatively offset 45° in each series relative to the other series.

Figure 1:
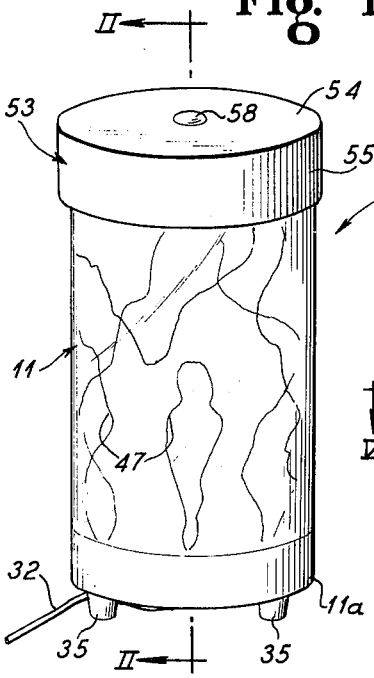
FIG. 1 is a perspective view of a display device embodying features of the present invention.

Operating air is supplied to the device in any suitable manner as for example through an inlet 28 connected as by means of a flexible conduit 29 with a suitable source of low pressure air such as an aquarium type pump 30 suitably mounted on a bottom wall 31 of the base member 11*a* and connected with a suitable source of electricity through a cable 32 which may be suitably connected with a house current and is desirably provided with a suitable on-off switch 33. Free air circulation into the chamber 18 within which the pump 30 is housed, is promoted by openings 34 (FIGS. 4, 6 and 7) in the base wall 31 at opposite sides of the pump 30. Free circulation through the air openings 34 is promoted by maintaining the base wall 31 spaced above a supporting surface by means of suitably spaced depending supporting and vertical spacing feet 35 (FIGS. 1, 2 and 7).

Means are provided for maintaining positive air pressure in the manifold chamber 22 even when the pump 30 is idle. Although the pump itself may be equipped internally by means of suitable valving to prevent regressive air leakage, a desirable arrangement includes or alternatively provides an automatic shut off valve 37 in the air conduit 29 (FIGS. 4 and 5). In a convenient form, the valve 37 comprises a normally closed resiliently flexible check valve having lips 38 downstream relative to the air pressure source and permitting pressure air to escape fairly freely, but automatically pinching closed to prevent regressive air leakage. A protective housing 39 encloses the valve 37 and provides suitable couplings with the upstream and downstream connected portions of the conduit 29.

Also supported by the base 11*a* are illumination means desirably comprising a vertically elongated replaceable electric lamp bulb 40 which is supported concentrically within the chamber 18 by means of a lamp socket 41 carried by suitable bracket 42 which is constructed and arranged to bridge over the pump unit 30. In order to enable access to the pump 30 as necessary, the bracket 42 is desirably provided with resiliently flexible slightly bifurcated depending supporting and connective legs 43 which are engaged in snap-in relation within an annular radially inwardly opening socket groove 44 in the inner wall provided by the base 11*a* about the inner side of the manifold chamber 22. Upstanding arcuate locating lugs 45 may be provided on the base wall 31 cooperative to hold the lower ends of the legs 44 in desired position. Electrical connection of the socket 41 in series in the same lead cable 32 as the pump 30 provides for control of the lamp 40 simultaneously with the pump 30 through the switch 33.

In operation of the device, air intruding the viscous material 20 in the chambers 15 and 17 by way of the orifices 27 from the manifold 22 by low pressure, i.e., 2 to 3 p.s.i., action of the pump 30 generates bubbles 47 (FIGS. 1 and 2) in the viscous liquid 20 and which bubbles slowly rise in the viscous liquid in each of the compartments 15 and 17 in contact with the walls defining those chambers. Due to the narrow chamber spaces provided by the chambers 15 and 17 and the viscosity of the fluid 20, the bubbles will spread out in a randomly occurring manner and vary in size, shape and location as they ascend. This provides an attractive visual effect of variable colors and color combinations, depending upon the coloration of the liquid 20 in the respective chambers 15 and 17 and different coloration of the translucent walls 12, 13 and 14, where they are also colored, as well as alignment or non-alignment of bubbles in the respective chambers. An additional or alternative wall color may be provided by equipping the innermost wall 14 with a colored layer 48 such as a spray coated layer or a laminar layer of suitably colored translucent plastic material. Unusual color effects can be attained by providing patterned or haphazard limited area gaps 48*a* in the layer 48 so that bubbles 47 passing the gaps appear to change color virtually as if another chamber of colored liquid were provided with bubble formation.

To provide for expansion of the fluid 20 due to the intruded air bubbles, the chambers 15 and 17 are preferably filled only to the extent which will provide adequate expansion room in the upper ends of the chambers. For example, the chambers may be filled to about two-thirds of their height in the shut down or nonoperating condition of the device.

The head 19 provides a roof 49 closing the top of each of the chambers 15 and 17. Venting of air from the top of each of the chambers 15 and 17 is provided for by small vent ports 50 (FIGS. 2, 3 and 6), which are preferably larger and of greater number than the orifices 27. To avoid spill-over in the event of escape of some of the fluid 20 through one of the vent ports 50, the upper end of the body 11 is desirably provided with a respective annular retaining trough 51 over each of the chambers 15 and 17 with which the vent ports 50 communicate. This permits any fluid that may escape through any of the ports 50 to drain back into the respective fluid chamber. Should by any chance any of the fluid spill over the outer side of the body 11, it will be readily detected and can be wiped off. Any spill-over at the inner side of the body and which may run down the inner face of the innermost wall section 14, will be caught in a safety trough 52 provided on the base 11*a* about the lower end of the inner wall section 14.

In order to assist in preventing leakage of the fluid 20 downwardly through the orifices 27 during quiescent, nonoperating periods of the device, and to prevent spilling in the event the device is tipped on its side or inverted during handling, storage or shipment, sealing means are provided for the crown or head end of the body 11, and more particularly to seal the ports 50 against fluid leakage outwardly or air leakage inwardly. For this purpose, a simple, efficient, easily manipulated structure comprises a displaceable sealing ring 52 dimensioned to effect sealing engagement with the head 19 and more particularly the surfaces of the head flanking the trough grooves 51. Desirably the ring 52 comprises a flat elastomeric annulus of suitable durometer and thickness carried by a cap 53 of generally inverted cup shape having a crown 54 of about the same diameter as the body 11 and a depending skirt flange 55 of an inside diameter to fit freely about the body 11. Means are provided for normally biasing the cap 53 toward closing, sealing engagement with the top of the body 11. Conveniently, such biasing means comprise a tension spring 57 connected at one end to a headed stud 58 carried centrally by the cap crown 54, while the opposite end of the spring is attached under tension to means comprising a crossbar 59 which is removably anchored at its opposite ends in respective downwardly opening notches fixed in shoulder bosses 61 integral with the upper end portion of the inner side of the wall section 14. In this manner, the cap 53 will be normally biased toward seating relation to the body 11, but when it is necessary to gain access into the body chamber 18 for replacing the lamp bulb 40 or for any other reason, the cap 53 can be pulled off of the top of the body 11 by stretching the preferably coiled tension spring 57 until access is gained into the upper open end of the chamber 18 and the anchoring tensioning rod 59 displaced from the shoulder notches 60 and thereby permitting complete removal of the cap 53 from the body 11. Reassembly of the cap 53 is effected in reverse order.

Figure 3:
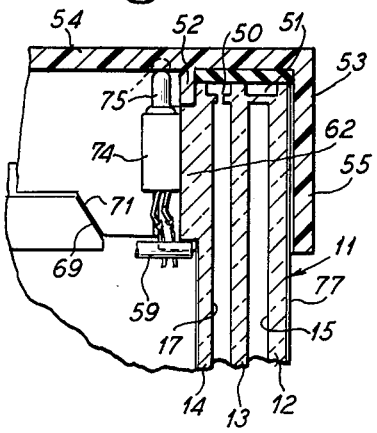
FIG. 3 is a fragmentary sectional elevational detail view taken in the same plane as FIG. 2 and showing the cover in the shut down sealing position on the device.

In order to lift the cap 53 from the upper end of the body 11 sufficiently for free venting of air from the chambers 15 and 17 during operation of the device without entirely removing the cap 53, means are provided in the form of cooperative cams and shoulders on the body 11 and the cap 53 by which simple turning of the cap 53 in one direction will lift the seal 52 sufficiently for free venting without lateral displacement of the cap, and reverse turning of the cap will return it to vent-sealing position. In a preferred arrangement, a plurality, such as three equally spaced cam and shoulder projections 62 are formed integrally on the inner side of the upper portion of the innermost wall section 14. In engagement therewith are complementary shoulder and cam extensions 63 depending from a narrow annular flange 64 integral with the inner side of the cap crown 54 and of a diameter to fit freely within the wall section 14, as best seen in FIG. 2. Each of the projections 62 has an upwardly facing shoulder 65 which is engageable by a complementary downwardly facing shoulder 67 on the associated extension 63 for holding the cap 53 in the unsealing position as shown in FIG. 2. Such position is attained by turning of the cap 53 from a sealing position as shown in FIG. 3 to effect riding of respective oblique cam surfaces 68 and 69 on the extension 63 upwardly along cam surfaces 70 and 71 respectively on the projections 62 in each instance. In the fully unsealed position, the cams 69 will engage with the cams 70 as stops which can be felt by the person turning the cap when these surfaces bump together. Since the shoulders 65 and 67 are horizontal, the cap 53 will be held in the unsealing position by tension of the spring 57 frictionally drawing the shoulder surfaces 65 and 67 snugly together. Release of the cap 53 to its vent sealing position is effected simply by turning the cap 53 in reverse to dislodge the shoulders 67 from the associated shoulders 65, the tensioned spring 57 acting to pull the cap downwardly when the cam surfaces 68 come into registration with and slide down the cam surfaces 70 until the sealing ring 52 bears sealingly against the body crown 19. Excessive twisting turning of the cap 53 in the seating or sealing direction is avoided by vertical shoulders 72 on the extensions 63 opposing corresponding vertical shoulders 73 on the cam shoulder projections 62.

Herein the switch 33 comprises a micro-switch 74 mounted on one of the projections 62 (FIGS. 2, 3 and 6), connected in series in the electrical circuit with the pump 30 and the lamp 40. This switch is normally closed when the cap 53 is in the unseated position, but has a control button or plunger 75 which projects upwardly to a sufficient extent to be engaged by and depressed by the cap crown 54 as shown in FIG. 3 to open the switch 74 and thus break the energizing circuit for the pump 30 and the lamp 40. Through this arrangement, the cap 53 may serve the dual function of a protective and sealing cap and operation controlling member.

When the device is shut down, it is desirable to conceal the inner parts of the device from view as might occur due to external illumination so disposed relative to the device as to shine thereinto. To this end, the wall section 12 may be made of a neutral density filter material such as gray tinted acrylic. Alternatively, the outer surface of at least the body 11 may be encased in a highly reflective coating or film lamina 77. Thereby, when the lamp 40 is illuminated, the light therefrom diffused through the wall sections 12, 13 and 14 and the fluid 20 will be visible throughout the wall area of the body 11, but when the lamp 40 is deenergized, the interior of the body 11 will, in effect, be invisible.

Figure 8:
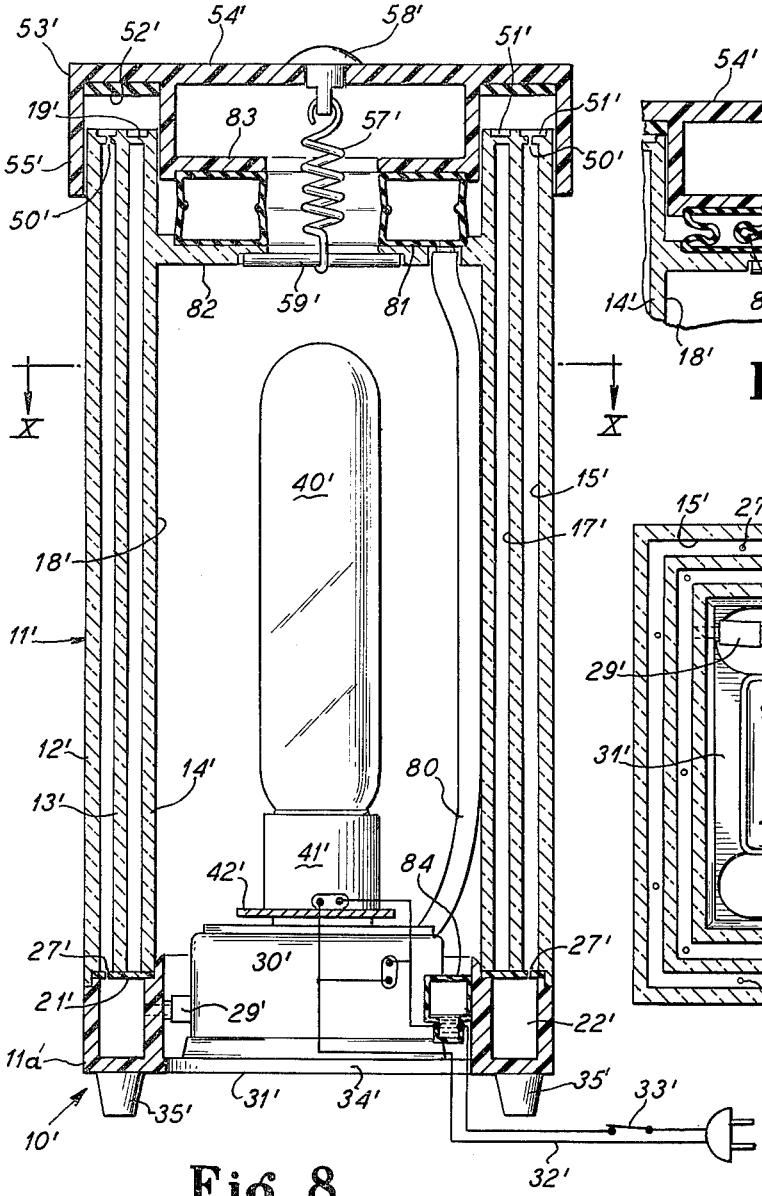
FIG. 8 is a vertical sectional view through a modification.
Figure 9:
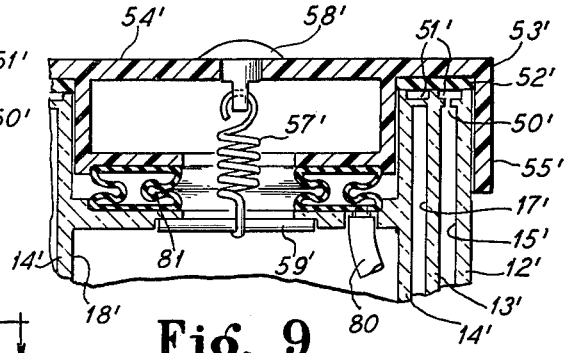
FIG. 9 is a similar fragmentary view of the upper end of FIG. 8.
Figure 10:
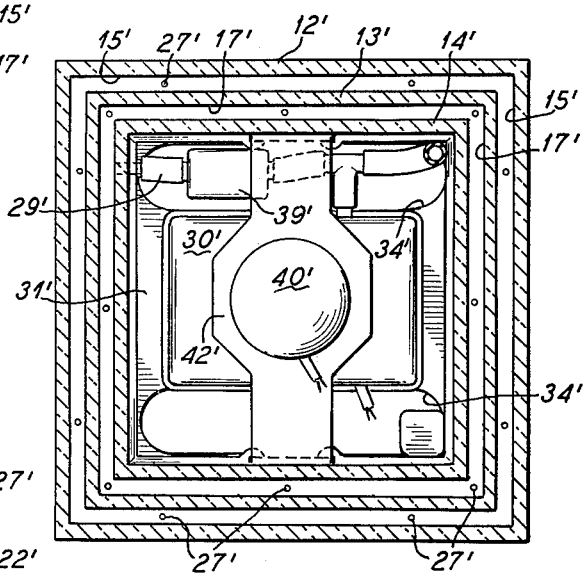
FIG. 10 is a transverse sectional view along the line X—X of FIG. 8.

In the modification of FIGS. 8–10, another geometric form of the device is shown, in this instance of square cross section instead of cylindrical, and safety sealing of the device 10' is effected in a manner which, although it could be adapted for the cylindrical form, is especially suitable for the quadrangular cross section wherein rotation of the cover 53' is precluded. For brevity the various elements of the device 10' which are substantially identical with the elements of the device 10 will not again be specifically described and it will be understood that as to such elements the description already given in respect to the corresponding elements in the device 10 will apply with equal effect. In this modified arrangement, instead of cam and shoulder means for moving the cap 53' between sealing seated position and unseated position, pneumatic means are provided. To this end, a branch air duct 80 leads from the air conduit 29' upwardly within the chamber 18' to a pneumatic cap actuator comprising a collapsible donut or annular hollow diaphram member 81. For this purpose, an annular diaphram supporting platform 82 integral with the upper end portion of the inner wall section 14' suitably spaced below the crown closure 19' carries the member 81 under a foot flange 83 integral with the inner side of the cap crown 54' and resting upon the member 81. Thereby, the biasing tension spring 57' which in this instance is anchored at its lower end by means of the bar 59' engaging with the platform 82, normally acts to pull the cap 53' down into sealing engagement of the sealing ring 52' with the crown 19' and thus seal the vent or exhaust ports 50', the member 81 then being collapsed as shown in FIG. 9. When the pump 30' is energized, together with the lamp 40' by closing of the control switch 33' in the electrical lead cable 32', not only is air pumped into the manifold 22, for intrusion into the chambers 15' and 17' as and for the purposes already described in connection with the device 10, but air is simultaneously pumped through the branch duct 80 into the donut member 81 and inflates the same to overcome the bias of the spring 57' and raise the cap 53' for unseating the seal 52', as exemplified in FIG. 8. Therefore the cap 53' automatically lifts from the sealing engagement with the top of the body 11' when the device is turned on for operation, and automatically closes when the devices is turned off.

As a safety measure to avoid spillage should the device 10' be tipped over while it is operating, means are provided to stop operation of the device instantly and permit the cap 53′ to resume its seated, sealing position. To this end, a safety mercury switch 84 is connected in series in the electrical energy line or cable 32′ and mounted on the base 11*a*′ in such manner that when the device 10′ is tipped over to any substantial extent from a vertical position, the mercury switch will break the circuit and stop operation of the pump 30′ and permit instantaneous deflation of the diaphram donut 81 under the bias of the spring 57′.

It will be understood that variations and modifications may be effected without departing from the spirit and scope of the novel concepts of this invention.

I claim as my invention:

1. A changeable color display device, comprising:
an upright tubular body having a plurality of differentially dimensioned translucent wall sections defining upright working chambers containing a liquid through which air can bubble upwardly;
said tubular body defining a substantial hollow space within the innermost of said wall sections;
annular manifold means concentric with the lower ends of said chambers and defining a central bottom opening from said space;
a base structure accessible through said opening;
means on said base structure for supplying air under pressure into said manifold;
orifices communicating said manifold with the lower ends of said chambers for intruding bubble air into the liquid material in the chambers;
a head sealing the upper ends of the chambers and having air venting ports opening therefrom;
and means supported by said base and carrying a selectively operable source of illumination extending upwardly in said space within the tubular body.

2. A device according to claim 1, wherein said air supplying means comprises a pump carried by said base structure, a replaceable bridge bracket supported by said base structure over said pump, and said source of illumination comprises a lamp supported by said bracket.

3. A device according to claim 1, including a closure cap carried by said head, a tensioned biasing spring normally biasing said cap toward sealing relation to said venting ports, and means selectively operable for holding said cap in a non-sealing relation to said ports and in opposition to said spring.

4. A device according to claim 3, including cam and shoulder means on said body and on said cap comprising said means for selectively holding the cap in non-sealing relation to said ports.

5. A device according to claim 3, wherein said means for holding the cap in non-sealing relation comprise an inflatable pneumatic member connected with said air supplying means.

6. A device according to claim 1, comprising a cap having a sealing element engageable with said head for sealing said ports, means normally biasing said cap toward said head, and means for holding said cap selectively in raised non-sealing relation to the ports comprising cam and shoulder structure on said cap and on said body, said cap being adapted to be manipulated manually.

7. A device according to claim 1, including a sealing cap having a sealing element engageable with said head for sealing said ports, means normally biasing said cap toward said head for sealing said ports, and a pneumatic actuator coupled with said air supplying means for unsealing said cap concurrently with supplying of air to said manifold whereby to open said ports.

8. A device according to claim 1, wherein the outermost of said wall sections includes means providing a light filter effect about said body providing an opaque appearance when said source of illumination is not operating.

9. A device according to claim 1, wherein said air supplying means and said illumination source are electrically operated, and safety means preventing operation of said air supplying means and illumination source when the device is tipped over from an upright position.

10. A device according to claim 1, including an upwardly displaceable member for sealing said ports, a spring normally biasing said member downwardly, and releasable means anchoring said spring relative to the upper ends of the chambers.

11. A device according to claim 1, including a light filtering medium between said illumination source and the inner of said chambers, and limited area gaps in said light medium.

12. A device according to claim 1, wherein said means for intruding air bubbles include an air conduit leading from said pump to said manifold, and a check valve in said conduit preventing regressive air flow in the conduit.

13. A device according to claim 1, including releasable means for sealing said ports, and means for preventing operation of said air supplying means and said illumination source when said sealing means is in sealng relation to said ports.

14. A changeable color display device, comprising:
means defining a plurality of juxtaposed closely spaced translucent upright working chambers containing a liquid through which air can bubble upwardly;
means including an electrically operated air pump for intruding air into the liquid through the lower ends of the chambers;
means for venting expended air from upper ends of the chambers;
an electrical illumination source behind the chambers;
releasable means for sealing said venting means against leakage of liquid from the upper ends of the chambers;
and means for preventing operation of said pump and illumination source when said sealing means is in sealing relation to said chambers.

15. A device according to claim 14, wherein said sealing means comprises a cap adapted to be raised from sealing relation to said chambers and to be lowered into sealing relation to said chambers, said operation preventing means comprising an electrical switch mounted in position to be actuated by said cap when it is lowered into sealing position.

16. A changeable color display device, comprising an upright tubular body having a plurality of differentially dimensioned translucent wall sections defining annular chambers about a hollow space which opens upwardly;
said chambers containing liquid through which air can bubble upwardly;
means for intruding air into the liquid through the lower ends of the chambers;
means for venting expended air from the upper ends of the chambers;
means for providing illumination in said space;

a releasable cap having means for sealing the upper ends of the chambers;

means normally biasing the cap into sealing relation to said upper ends;

and means for selectively effecting movement of the cap out of the sealing relation in opposition to said biasing means and including structure in part carried by said cap and in part by said tubular body.

17. A device according to claim 16, wherein said means for effecting selective movement of the cap comprise cam and shoulder means projecting downwardly from the cap into said space, and complementary cam and shoulder means carried by said body within said space and cooperating with said downwardly projecting cam and shoulder means.

18. A device according to claim 16, wherein said means for effecting movement of the cap comprise an inflatable pneumatic member supported by said tubular body, and means on the cap resting on said member.

* * * * *